US008807063B2

(12) United States Patent
Mariani et al.

(10) Patent No.: US 8,807,063 B2
(45) Date of Patent: Aug. 19, 2014

(54) BOAT

(76) Inventors: Sandro Mariani, Campiano di Ravenna (IT); Matteo Del Sorbo, Ascrea (IT)

( * ) Notice: Subject to any disclaimer, the term of this patent is extended or adjusted under 35 U.S.C. 154(b) by 51 days.

(21) Appl. No.: 13/522,428

(22) PCT Filed: Jan. 18, 2010

(86) PCT No.: PCT/IT2010/000010

§ 371 (c)(1),
(2), (4) Date: Jul. 16, 2012

(87) PCT Pub. No.: WO2011/086586

PCT Pub. Date: Jul. 21, 2011

(65) Prior Publication Data

US 2012/0291692 A1 Nov. 22, 2012

(51) Int. Cl.
*B63B 7/04* (2006.01)

(52) U.S. Cl.
CPC ..... *B63B 7/04* (2013.01)
USPC ..... 114/352

(58) Field of Classification Search
USPC ..... 114/77 A, 77 R, 352, 353, 354
See application file for complete search history.

(56) References Cited

U.S. PATENT DOCUMENTS

| | | | | | |
|---|---|---|---|---|---|
| 1,449,222 | A | * | 3/1923 | Goethel | 114/352 |
| 1,916,093 | A | * | 6/1933 | Cormier | 114/352 |
| 2,040,373 | A | * | 5/1936 | Green | 114/352 |
| 2,443,767 | A | * | 6/1948 | House | 114/352 |
| 2,443,768 | A | * | 6/1948 | House | 114/352 |
| 2,533,220 | A | * | 12/1950 | Carter | 114/353 |
| 2,650,376 | A | * | 9/1953 | Sommer | 114/352 |
| 3,090,973 | A | | 5/1963 | Levinson | |
| 3,340,552 | A | * | 9/1967 | Moye | 114/352 |
| 3,381,322 | A | * | 5/1968 | Cook | 114/352 |
| 4,779,556 | A | | 10/1988 | Smith | |

FOREIGN PATENT DOCUMENTS

| | | | |
|---|---|---|---|
| FR | 729245 | A | 7/1932 |
| FR | 1456055 | A | 5/1966 |
| FR | 2668444 | A1 | 4/1992 |

* cited by examiner

*Primary Examiner* — Lars A Olson
(74) *Attorney, Agent, or Firm* — Pearne & Gordan LLP

(57) ABSTRACT

A boat comprises a bow (21) which can move between a first, sailing configuration and a second configuration in which it is at least partly inserted in a housing (20) which is at least partly formed by the remaining parts of the boat (1).

16 Claims, 8 Drawing Sheets

BOAT

TECHNICAL FIELD

This invention relates to a boat, in particular a tender for a larger boat.

BACKGROUND ART

There are prior art tenders which are used to allow the crew and guests of a large yacht to easily get about once the yacht has moored.

When the yacht is sailing normally, such tenders are placed in special garages. In the yacht, such garages reduce the on-board space which can be used for other purposes and in any case they have compact dimensions. To minimise the dimensions of such garages they are often positioned in a zone between the yacht motors and a sun deck.

DISCLOSURE OF THE INVENTION

This invention has for an aim to overcome the above-mentioned disadvantages, by providing a boat whose dimensions can be minimised before it is placed in a garage.

This aim and others, which are more apparent in the description which follows, are achieved, in accordance with this invention, by a boat with the structural and functional features described in the independent claims herein, other embodiments of the boat are described in the dependent claims.

BRIEF DESCRIPTION OF THE DRAWINGS

The invention is described in more detail below, with reference to the accompanying drawings, which illustrate a preferred non-limiting embodiment of the invention.

DETAILED DESCRIPTION OF THE PREFERRED EMBODIMENTS OF THE INVENTION

Figure 1:
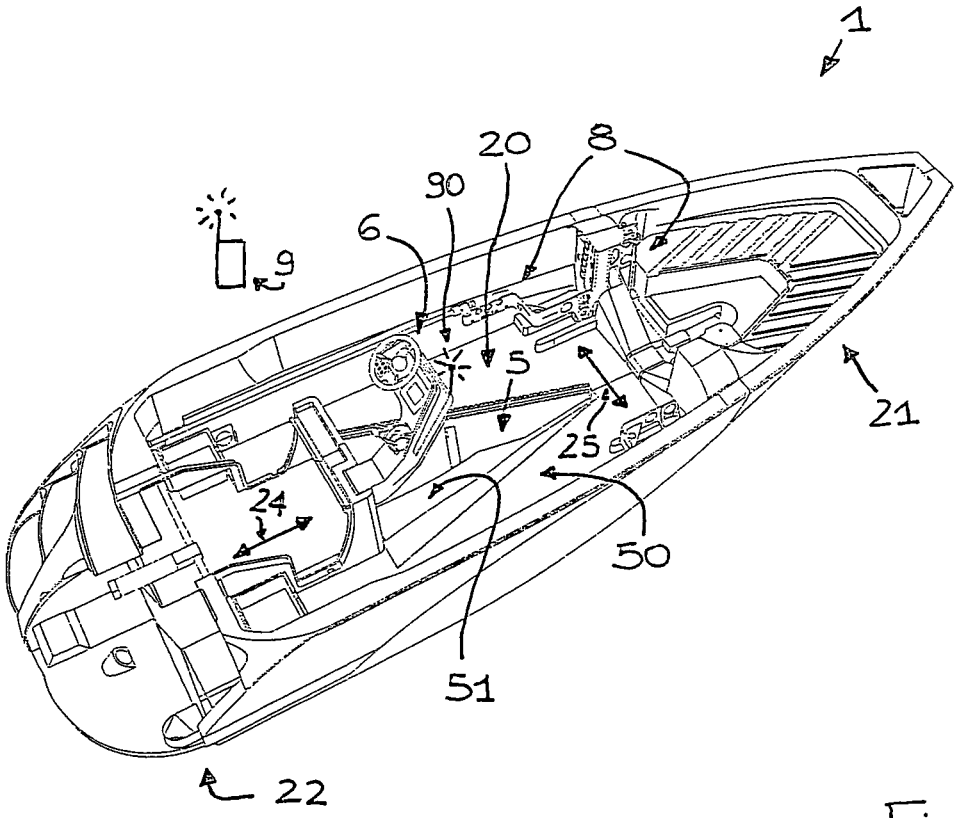
FIGS. 1, 2, 3, 4, 5, 6, 7 show in sequence and in perspective views a variation of the configuration of the boat made in accordance with this invention.
Figure 1A:
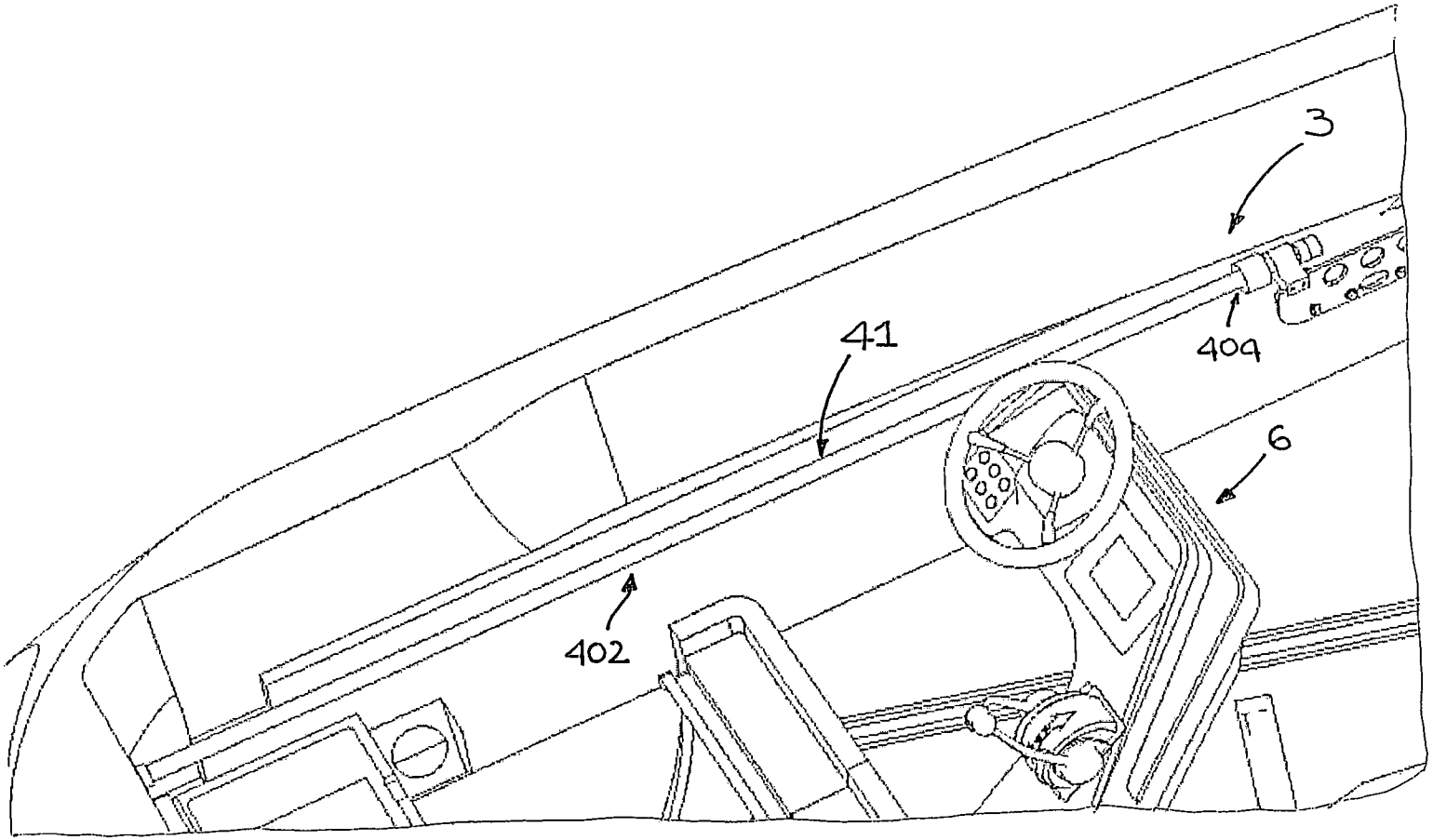
FIGS. 1*a* and 1*b* show two enlarged views of FIG. 1.
Figure 1B:
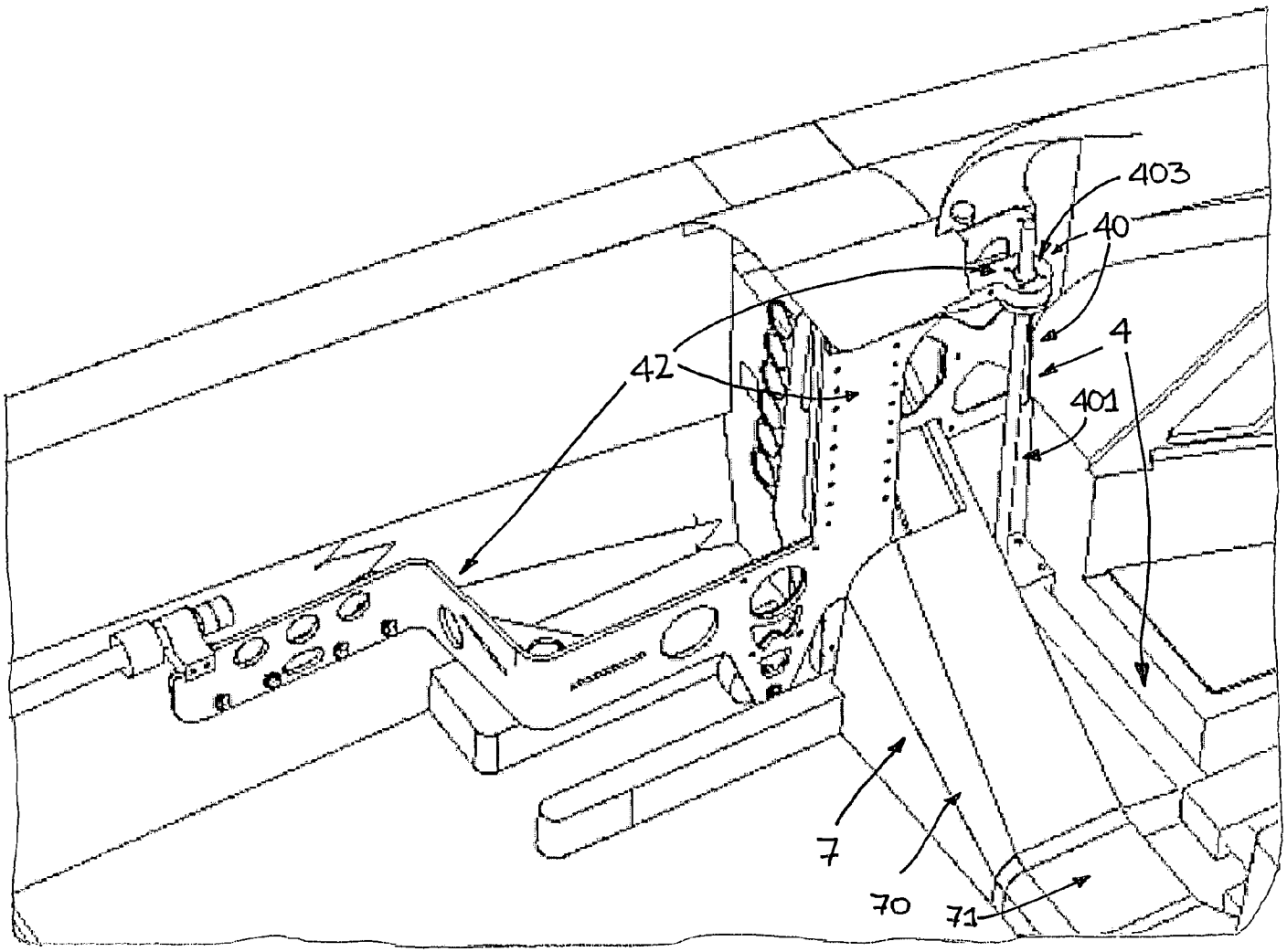

In the accompanying drawings the numeral 1 denotes a boat.

The boat 1 comprises a bow 21 which is mobile between a first, sailing configuration and a second configuration in which it is at least partly inserted in a housing 20 which is at least partly formed by remaining parts of the boat 1. The first and second configurations of the bow 21 are two separate configurations. The mobile bow 21 comprises a hull which in the second configuration of the mobile bow 21 is at least partly inserted in the housing 20. Advantageously, in the second configuration of the mobile bow 21 the whole of the hull of the mobile bow 21 is inserted in the housing 20. Appropriately, during normal sailing, at least one portion of the housing 20 is intended to at least partly accommodate the crew. In the preferred embodiment said housing 20 is not closed at the top, whilst at the bottom and at least partly laterally it is delimited by portions of the boat 1.

Advantageously, the first, sailing configuration is a configuration in which the mobile bow 21 extends at least mostly in front of the remaining parts of the boat 1. In the first, sailing configuration a joining zone between the hull of the mobile bow 21 and the remaining parts of the boat 1 can be identified. The joining zone and the zones immediately adjacent to it have a streamlined design. Appropriately, in the first, sailing configuration the mobile bow 21 is intended to be at least partly in contact with the water in which the boat 1 is immersed.

Advantageously, in the second configuration the mobile bow 21 is not immersed in water even if the boat 1 is immersed in water.

Advantageously, the mobile bow 21 translates, passing from the first configuration to the second configuration and/or vice versa. During the movement from the first configuration to the second configuration of the mobile bow 21 the translating movement occurs in sequence in more than one direction. The translating movement, unlike other types of movement (for example tipping), allows lifting of the mobile bow 21 to be minimised, thereby giving the boat 1 greater stability (since the centre of gravity remains lower) above all in the presence of a strong wind.

Appropriately, the boat 1 comprises a stern 22. The boat 1 extends mainly in a first, stern-bow direction 24. Appropriately, to define the first direction 24 the mobile bow 21 is in the first, sailing configuration.

In the second configuration of the mobile bow 21 at least half, preferably at least three quarters of the length of the mobile bow 21 is inserted in the housing 20, said length being measured in the first direction 24. This allows boat 1 dimensions to be minimised when it is placed in a garage. The boat 1 can normally float even in the second configuration.

The boat 1 comprises means 8 for shifting the mobile bow 21 between the first and second configurations.

The shifting means 8 comprise first means 3 for moving the mobile bow 21 parallel with the first direction 24.

The shifting means 8 comprise means 4 for lifting/lowering the mobile bow 21.

During the mobile bow 21 passage from the first configuration to the second configuration and/or vice versa, both the first movement means 3 and the lifting/lowering means 4 operate. Advantageously, operation of the first movement means 3 and the lifting/lower means 4 is alternated.

Advantageously, the boat 1 comprises portable remote control means 9 for the means 8 for shifting the mobile bow 21. This allows the passage between the first and second configurations to be performed even if the user operating the portable remote control means 9 is not on board the boat 1 (for example, he may be on another boat). Advantageously, the portable means 9 comprise a remote control. The shifting means 8 are operatively linked to receiver means 90 (usually an antenna) suitable for picking up the signal coming from the portable means 9. An electronic control unit encodes the signals arriving from the receiver means 90 and transmits the respective commands to the shifting means 8.

The lifting/lowering means 4 comprise first means for guiding the lifting/lowering motion of the mobile bow 21. The first guide means 40 translate in the first direction 24 when the first movement means 3 are operated. Advantageously, at least part of the first guide means 40 extend vertically (usually so that they are substantially at a right angle to the surface on which the boat floats). The first guide means 40 comprise for example at least a first shaft 401 with an outer spiral thread (preferably they comprise a pair of first shafts 401 with an outer spiral thread which are spaced from each other). The at least one first shaft 401 shifts (preferably translates) in the first direction 24 when the first movement means 3 are operated. The at least one first shaft 401 engages in a carriage 42 able to translate in the first, stern-bow direction 24. The translating carriage 42 is advantageously equipped with means that allow it to run easily, for example wheels. The carriage 42 is part of the boat 1, in particular part of the first movement means 3. The easy running means facilitate carriage 42 running along the remaining parts of the boat 1. The lifting means 4 also comprise a first motor (usually electric) which drives the movement of the at least one first shaft 401 of the first guide means 40. A transmission allows the first electric motor to be connected to the pair of first shafts 401. The first movement means 3 comprise second guide means 41 which guide the movement of the mobile bow 21 in the first stern-bow direction 24. The second guide means 41 comprise at least a second shaft 402 with an outer spiral thread (preferably they comprise a pair of second shafts 402 each having an outer spiral thread, which are suitably spaced from each other). The first movement means 3 also comprise a second motor (usually electric) which drives the movement of the at least one second shaft 402.

The at least one second shaft 402 engages with the translating carriage 42. In particular, a rotation of the at least one second shaft 402 causes the carriage 42 to translate in the first, stern-bow direction 24. The translating carriage 42 has at least one first hole 403 in which the first shaft 401 engages. The translating carriage 42 has at least one second hole 404 in which the second shaft 402 engages. The first and second holes are in two directions which are at right angles to each other. The first and second holes 403, 404 appropriately do not intersect with each other.

The first hole 403 has a matching shape which meshes with the spiral thread of the first shaft 401. The second hole 404 has an inner matching shape which meshes with the spiral thread of the second shaft 402.

The at least one second shaft 402 extends at the sides of the boat 1. Considering the pair of second shafts 402, one of the two shafts 402 extends at one side of the boat 1 and the other extends at the other side of the boat 1. A rotation of the at least one first shaft 401 causes lifting or lowering of the mobile bow 21 relative to the carriage 42 able to translate in the first direction 24 (this is also accompanied by lifting or lowering of the first shaft 401 relative to the translating carriage 42).

Appropriately, passing from the first configuration to the second configuration of the mobile bow 21, the lifting/lowering means 4 are operated at least during a first and a second period of time which are separate from each other. Between the first period of time and the second period of time the first movement means 3 are operated.

Preferably, passing from the first configuration to the second configuration of the mobile bow 21, the lifting/lowering means 4 are operated at least during a first, a second and a third period of time which are separate from each other. Both between the first and the second periods of time and between the second and the third periods of time the first movement means 3 are operated.

A similar situation may be repeated when passing from the second configuration to the first configuration. This mobile bow 21 stepping motion allows the mobile bow 21 to pass from the first configuration to the second configuration and vice versa, overcoming the obstacles formed by elements of the boat 1 simultaneously following the profile of the boat 1. This allows boat 1 stability to be improved (limiting raising of the boat 1 centre of gravity).

Advantageously, the boat 1 comprises boat 1 stiffening means 7 acting transversally to the first, stern-bow direction 24 of the boat 1 and connecting two sides 23 of the boat 1.

The stiffening means 7 are outside the mobile bow 21 and are located at the zone connecting the mobile bow 21 to the remaining parts of the boat 1.

The stiffening means 7 comprise a wall 70 projecting from the bottom upwards relative to the physical vertical. The wall 70 has a hollow 71 facing upwards. Moreover, the wall 70 connects the two sides 23 of the boat 1. The hollow 71 reduces the maximum lifting required for the mobile bow 21 to pass from the first configuration to the second configuration and vice versa. Preferably, but not necessarily, the wall 70 forms a waterproof barrier. In any case, there are normally pumps present which expel any water that gets into the boat 1.

In the second configuration of the mobile bow 21, the mobile bow 21 projects upwards from the sides of the boat 1 for a length of less than half a meter.

In the second configuration of the mobile bow, the height of the mobile bow 21 is contained in the remaining parts of the boat 1. In that case, the mobile bow 21 does not project upwards from the sides of the remaining parts of the boat 1 (in particular the hull 2). In this way, as well as reducing the boat 1 longitudinal dimensions it is also possible to limit or avoid an increase in its vertical dimensions.

The boat 1 comprises an openable trap door 5 which in a closed configuration helps to form a boat 1 treadable zone 50 and which in an open configuration (see for example FIG. 1) allows access to a compartment 51 below, which in the second configuration of the mobile bow 21 at least partly accommodates the mobile bow 21. Advantageously, the openable trap door 5 projects into the compartment 51 below. Advantageously, the openable trap door 5 comprises two laterally hinged portions.

Appropriately, the boat 1 comprises a fold-down control console 6, in the first configuration of the mobile bow 21 the control console 6 being in an operating configuration, in the boat 1 second configuration the control console 6 being in a configuration in which its dimensions are minimised along the physical vertical. This allows the boat 1 vertical dimensions to be limited.

In the second configuration of the mobile bow 21 the console 6 partly surmounts a portion of the mobile bow 21. In this way, part of the mobile bow 21 is housed below the console 6 to reduce the boat 1 dimensions in the first, stern-bow direction 24.

There is a second direction 25 which is parallel with the surface on which the boat 1 floats and at a right angle to the first, stern-bow direction 24. Appropriately, the mobile bow 21 has a streamlined shape. The maximum width of the mobile bow 21 measured in the second direction 25 is less than the maximum width, measured in the second direction 25, of the housing 20 in which the mobile bow 21 is at least partly inserted in the second configuration of the mobile bow 21.

The boat 1 comprises a sensor which checks that the mobile bow 21 is correctly positioned in the first configuration. An electronic control unit, upon receiving from the sensor a signal indicating incorrect positioning of the mobile bow 21 in the first configuration, prevents operation of the boat 1 motors which provide it with thrust in the water.

Very advantageously, the boat 1 is a tender. Such a tender is usually a support boat belonging to a larger yacht.

Figure 2:
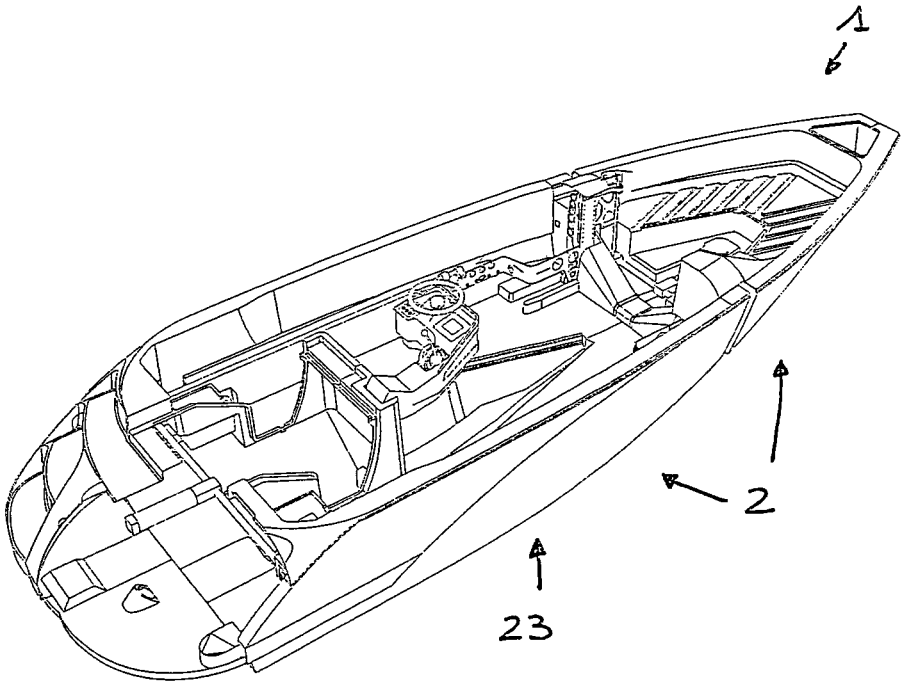
Figure 3:
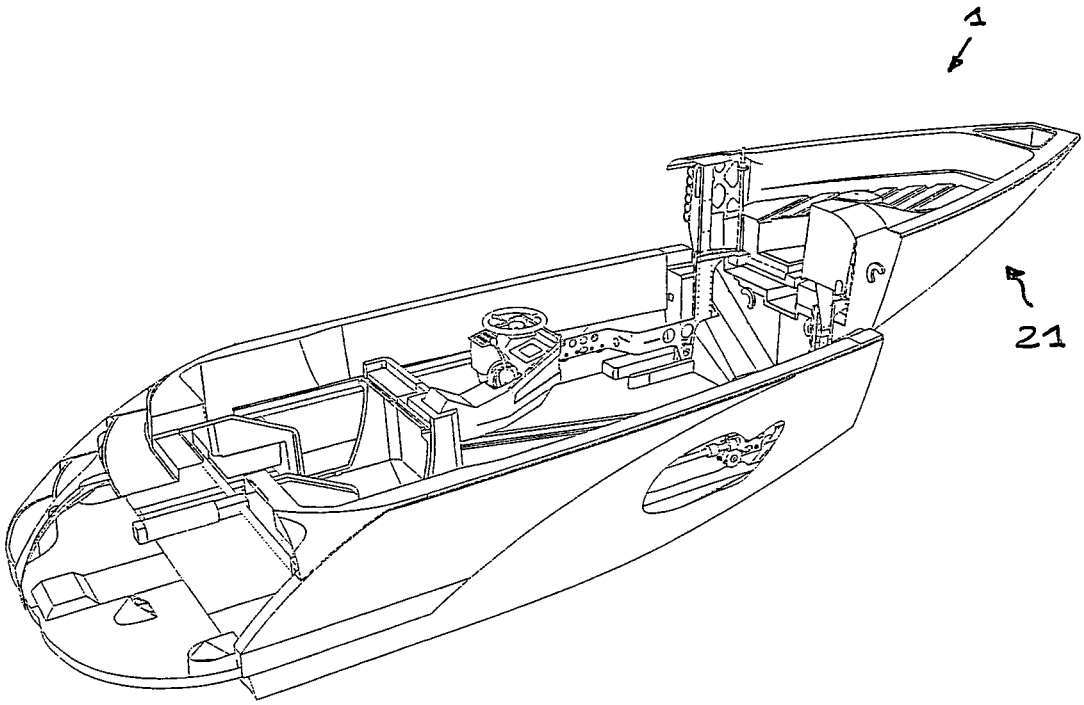
Figure 4:
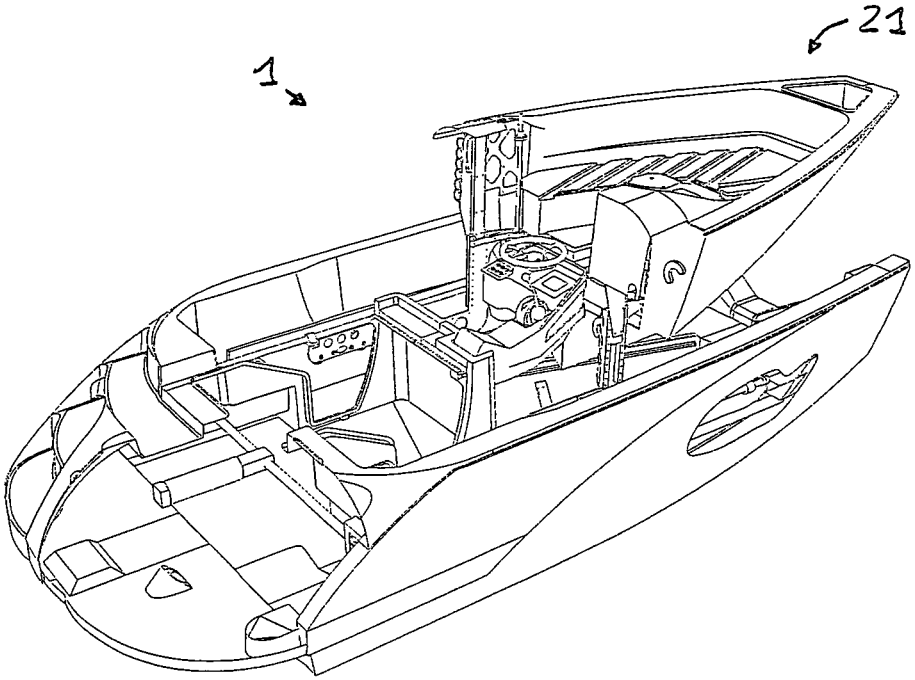
Figure 5:
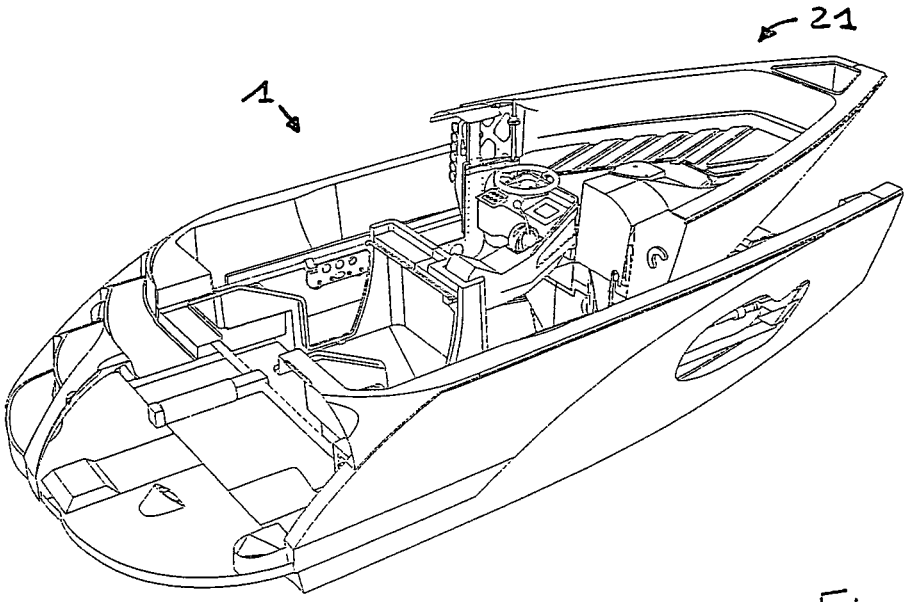
Figure 6:
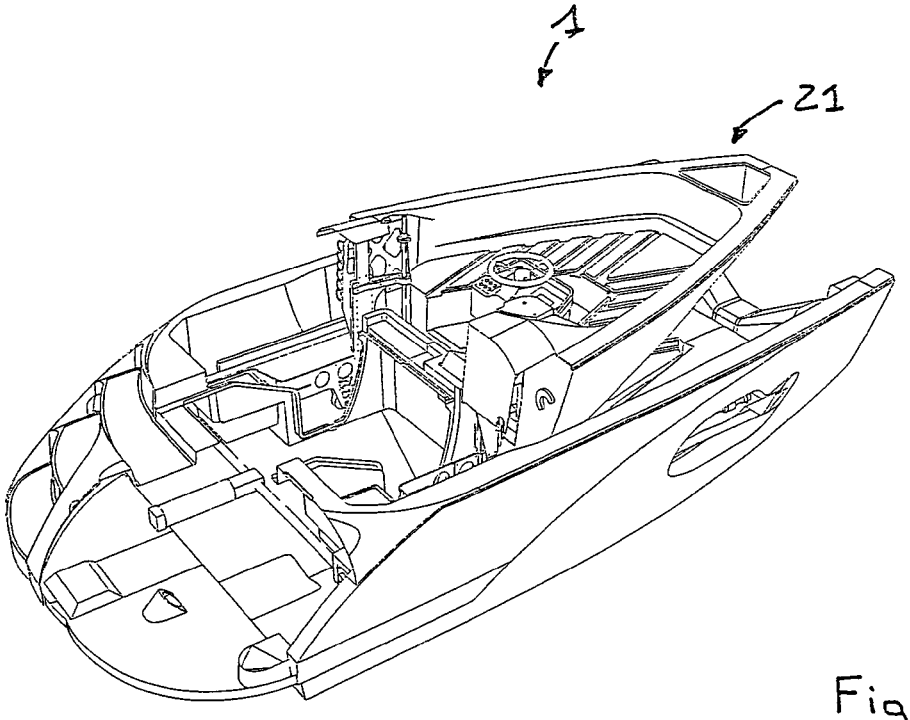
Figure 7:
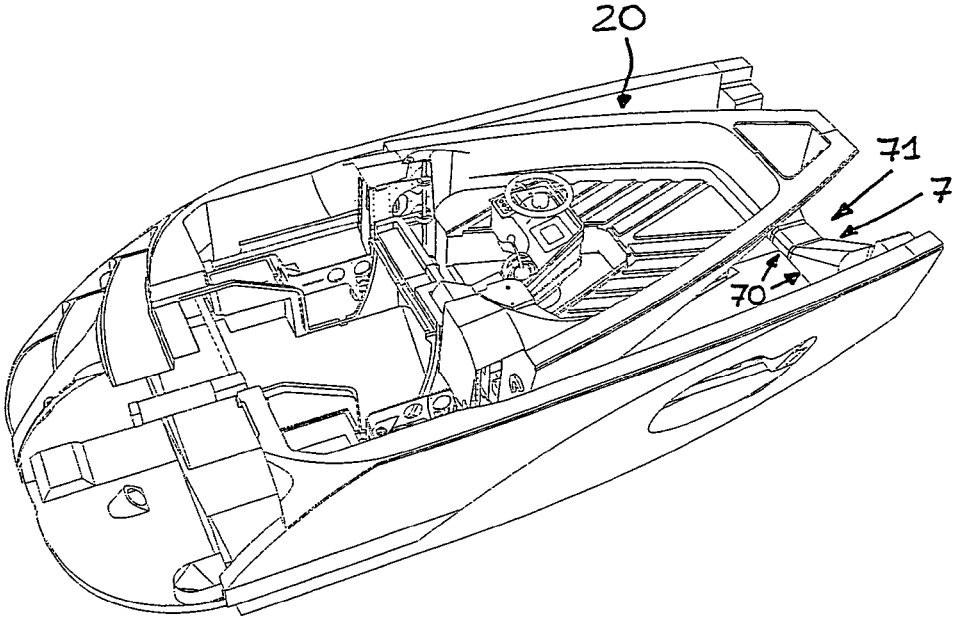
Figure 8A:
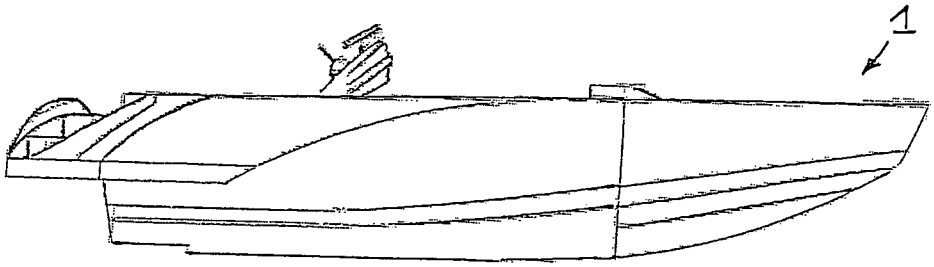
FIGS. 8*a* to 8*g* show in sequence and in side views a variation of the configuration of the boat made in accordance with this invention.
Figure 8B:
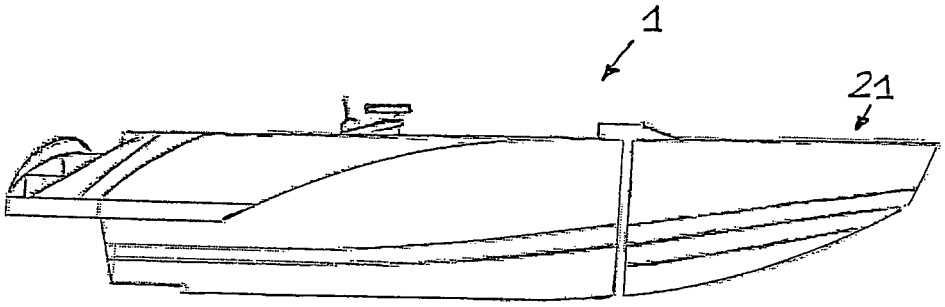
Figure 8C:
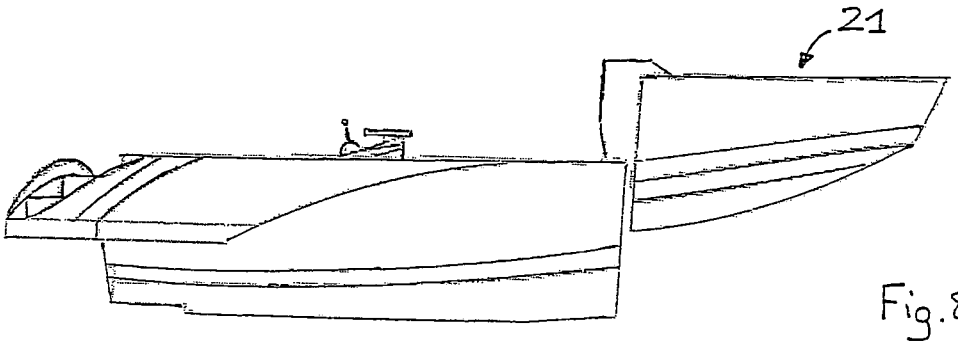
Figure 8D:
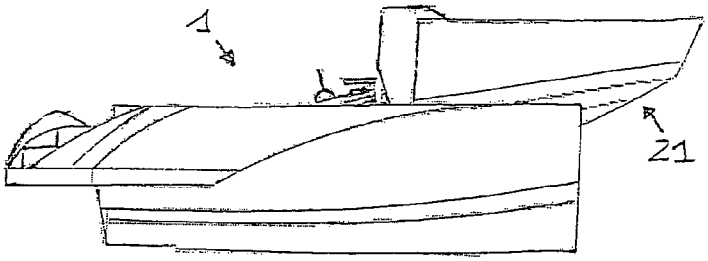
Figure 8E:
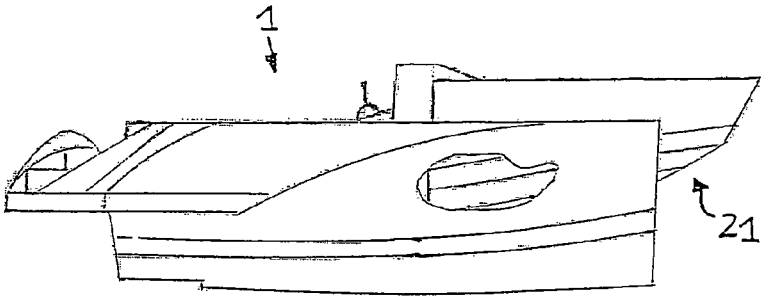
Figure 8F:
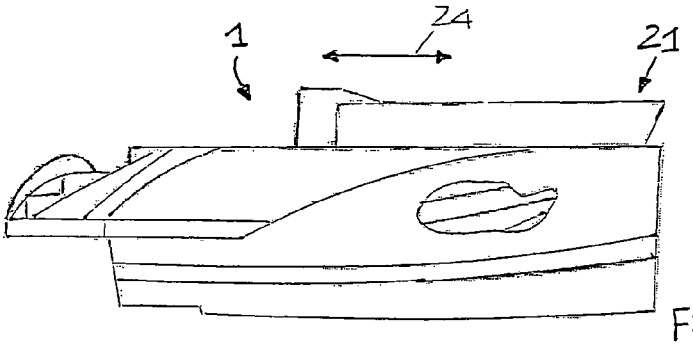
Figure 8G:
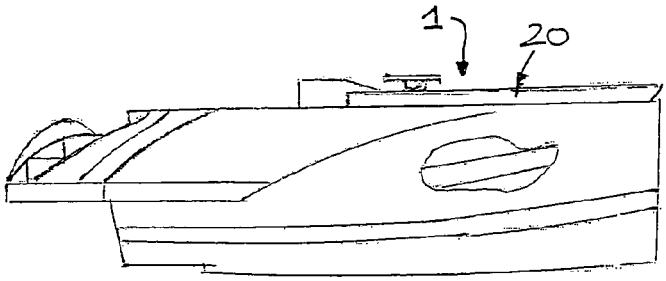

This invention also relates to a method for passing from a boat 1 operating configuration to a garaging configuration. The boat operating configuration is adopted when the mobile bow 21 is in the first configuration. The boat 1 garaging configuration is adopted when the mobile bow 21 is in the second configuration. Appropriately, said method comprises at least the following steps:

lifting the mobile bow 21 by means of an upward translation (see the passage from FIG. 2 to FIG. 3 or from FIGS. 8*b* to 8*c*);

shifting the mobile bow 21 towards the stern 22 by means of a translation in the first direction 24 and passing over the wall 70 (see the passage from FIG. 3 to FIG. 4 or from FIG. 8*c* to FIG. 8*d*);

lowering the mobile bow 21 by means of a downward translation (see the passage from FIG. 4 to FIG. 5 or from FIG. 8*d* to FIG. 8*e*);

shifting the mobile bow 21 towards the stern 22 by means of a translation in the first direction 24, positioning a portion of the console 6 above a portion of the mobile bow 21 (see the passage from FIG. 5 to FIG. 6 or from FIG. 8*e* to FIG. 8*f*);

lowering the mobile bow 21, at least partly inserting it in the compartment 51 below the trap door 5 (see the passage from FIG. 6 to FIG. 7 or from FIG. 8*f* to FIG. 8*g*).

Advantageously, before the step of lifting the mobile bow 21 by means of an upward translation, a translation of the mobile bow 21 in the first direction and away from the remaining parts of the boat 1 is performed (see the passage from FIG. 1 to FIG. 2 or from FIG. 8*a* to FIG. 8*b*). This allows the mobile bow 21 to be moved away from the remaining parts of the boat 1, allowing the subsequent lifting without interfering with the remaining parts of the boat.

Advantageously, to pass from the second configuration to the first configuration the above-mentioned steps are repeated in reverse order.

The invention brings important advantages.

First, it allows boat dimensions to be minimised when it is not being used. Said reduction in dimensions mainly applies in the first direction of extension, but may also apply to the height of the boat. If the boat is a tender this is particularly important, since it allows a reduction of the dimensions of a garage made on the yacht to which the tender belongs.

The invention described above may be modified and adapted in several ways without thereby departing froth the scope of the inventive concept.

Moreover, all details of the invention may be substituted by other technically equivalent elements.

In practice, all of the materials used, as well as the dimensions may vary according to requirements.

The invention claimed is:

1. A boat, comprising a bow which is mobile between a first, sailing configuration and a second configuration in which it is at least partly inserted in a housing which is at least partly formed by remaining parts of the boat, wherein the mobile bow translates, passing from the first configuration to the second configuration and/or vice versa, wherein said boat comprises a stern and extends mainly in a first, stern—mobile bow direction, said boat further comprising means for shifting the mobile bow between the first and second configurations, said shifting means comprising:

first means for moving the mobile bow parallel with the first direction;

means for lifting/lowering the mobile bow; during the passage from the first configuration to the second configuration of the mobile bow and/or vice versa, both the first movement means and the lifting/lowering means operating.

2. The boat according to claim 1, wherein the mobile bow comprises a hull which in the second configuration of the mobile bow is at least partly inserted in the housing.

3. The boat according to claim 1, wherein in the second configuration of the mobile bow at least three quarters of the length of the mobile bow, measured in the first direction, are inserted in the housing.

4. The boat according to claim 1, wherein it comprises portable remote control means for the means for shifting the mobile bow.

5. The boat according to claim 4, wherein the lifting/lowering means comprise means for guiding the lifting/lowering motion of the mobile bow, said guide means translating in the first direction when the first movement means operate.

6. The boat according to claim 4, wherein, passing from the first configuration to the second configuration of the mobile bow, the lifting/lowering means operate at least during a first, a second and a third period of time, said periods of time being separate;

the first movement means operating both between the first and second periods of time and between the second and third periods of time for operation of the lifting/lowering means.

7. The boat according to claim 1, wherein it comprises boat stiffening means acting transversally to the boat first stern—bow direction and connecting two sides of the boat.

8. The boat according to claim 7, wherein the stiffening means are outside the mobile bow and are located close to the zone connecting the mobile bow to the remaining parts of the boat.

9. The boat according to claim 7, wherein the stiffening means comprise a wall projecting from the bottom upwards relative to the physical vertical and having a hollow facing upwards and connecting the two sides of the boat.

10. The boat according to claim 1, wherein in the second configuration of the mobile bow, the height of the mobile bow is contained in the remaining parts of the boat.

11. The boat according to claim 1, wherein it comprises an openable trap door which in a closed configuration helps to form a boat treadable zone and which in an open configuration allows access to a compartment below, which in the second configuration of the mobile bow at least partly accommodates the mobile bow.

12. The boat according to claim 1, wherein it comprises a fold-down control console, in the first configuration of the mobile bow the control console being in an operating configuration, in the boat second configuration the control console being in a configuration in which its dimensions are minimised along the physical vertical.

13. The boat according to claim 12, wherein in the second configuration of the mobile bow the console partly surmounts a portion of the mobile bow.

14. The boat according to claim 1, wherein the mobile bow (21) has a streamlined shape.

15. The boat according to claim 1, wherein it is a tender.

16. A method for passing from an operating configuration to a garaging configuration for a boat according to claim 9, wherein the method comprises at least the following steps:

lifting the mobile bow by means of an upward translation;

shifting the mobile bow towards the stern by means of a translation in the first direction and passing over the wall;

lowering the mobile bow by means of a downward translation;

shifting the mobile bow towards the stern by means of a translation in the first direction, positioning a portion of the console above a portion of the mobile bow;

lowering the mobile bow, at least partly inserting it in a compartment below a trap door.

* * * * *